US012557869B2

(12) United States Patent
Chang

(10) Patent No.: US 12,557,869 B2
(45) Date of Patent: Feb. 24, 2026

(54) ARTICLE OF HEADWEAR

(71) Applicant: NIKE, Inc., Beaverton, OR (US)

(72) Inventor: Leo S. Chang, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 19/042,693

(22) Filed: Jan. 31, 2025

(65) Prior Publication Data

US 2025/0248474 A1 Aug. 7, 2025

Related U.S. Application Data

(60) Provisional application No. 63/549,114, filed on Feb. 2, 2024.

(51) Int. Cl.

| | |
|---|---|
| ***A42C 5/04*** | (2006.01) |
| ***A42B 1/02*** | (2006.01) |
| ***A42B 1/241*** | (2021.01) |

(52) U.S. Cl.

CPC ..... *A42C 5/04* (2013.01); *A42B 1/02* (2013.01); *A42B 1/241* (2013.01)

(58) Field of Classification Search

CPC ..... A42B 1/008; A42B 1/241

See application file for complete search history.

(56) References Cited

U.S. PATENT DOCUMENTS 1,496,330 A * 6/1924 Tollefson ..... A41D 27/20 2/256
1,613,675 A * 1/1927 Peedie ..... A42B 1/241 2/209.14
1,869,652 A * 8/1932 Baker ..... A42B 1/24 2/171.7
2,007,235 A * 7/1935 Elberta ..... A42B 1/006 2/209.13
2,158,571 A 5/1939 Culp
2,335,630 A 11/1943 Bachardy (Continued)

FOREIGN PATENT DOCUMENTS

KR 20200000853 U 10/2018
KR 20220073227 A 6/2022

OTHER PUBLICATIONS

"ICED Cap Arctic—Neon Yellow with Black Trim," icedcap.com. Dec. 4, 2023.https://web.archive.org/web/20231204091446/https://www.icedcap.com/collections/iced-cap-arctic/products/polar-iced-cap-neon-yellow-with-black-trim.

(Continued)

*Primary Examiner* — Alissa L Hoey
*Assistant Examiner* — Akwokwo Olabisi Redhead
(74) *Attorney, Agent, or Firm* — Bookoff McAndrews PLLC

(57) ABSTRACT

An article of headwear with a crown including a front portion, a first side, a second side disposed opposite the first side, and a back side opposite the front portion, wherein the crown includes an apex disposed at a top most point of the crown; a bill extending away from the front portion of the crown; and a mesh layer attached to the crown, the mesh layer extending from the first side of the crown to the second side of the crown and including a first end, a second end, a left side, and a right side, wherein the mesh layer forms a pocket between the first end, the second end, the left side, and the right side, the pocket bounded at its top by the mesh layer and bounded at its bottom by the crown.

19 Claims, 6 Drawing Sheets

(56) References Cited

U.S. PATENT DOCUMENTS

| | | | | | |
|---|---|---|---|---|---|
| 2,615,168 | A * | 10/1952 | Springer | A42B 1/241 | 2/209.3 |
| 3,070,803 | A | 1/1963 | Evelyn, V | | |
| 3,090,045 | A | 5/1963 | Howard | | |
| 4,080,665 | A * | 3/1978 | Hodes | A42B 1/006 | 2/209.12 |
| 4,104,741 | A * | 8/1978 | Shaw | A42B 1/24 | 472/66 |
| 4,165,542 | A | 8/1979 | McLaughlin | | |
| 4,312,076 | A * | 1/1982 | Gamm | A42B 1/241 | 2/209.13 |
| 4,451,935 | A * | 6/1984 | Henschel | A42B 1/241 | 2/253 |
| 4,472,837 | A * | 9/1984 | Saxton | A42B 1/241 | 2/171.4 |
| 4,484,363 | A | 11/1984 | Varanese | | |
| 4,768,232 | A * | 9/1988 | Villalobos | A63B 71/143 | D2/866 |
| 4,815,144 | A | 3/1989 | Martin | | |
| 5,197,292 | A * | 3/1993 | McPherson | A42C 5/04 | 62/530 |
| 5,465,426 | A * | 11/1995 | Beaton | A42B 1/248 | 40/329 |
| 5,548,847 | A * | 8/1996 | Spicijaric | A42B 1/248 | 40/329 |
| 5,557,807 | A | 9/1996 | Hujar et al. | | |
| 5,630,230 | A * | 5/1997 | Fujino | A41D 20/005 | 2/200.1 |
| 5,724,678 | A * | 3/1998 | McCallum | A42B 1/241 | 2/209.13 |
| 5,907,871 | A * | 6/1999 | Austin | A63B 71/143 | 2/209.12 |
| 6,481,021 | B2 | 11/2002 | Spell | | |
| 6,792,624 | B2 * | 9/2004 | Simmons | A42B 1/008 | 2/171.2 |
| 8,166,772 | B2 | 5/2012 | Cho | | |
| 11,241,057 | B2 * | 2/2022 | Bloniarz, Jr. | A42B 1/02 | |
| 2005/0076420 | A1 * | 4/2005 | Hafif | A42B 1/205 | 2/209.13 |
| 2006/0005291 | A1 | 1/2006 | Bedford | | |
| 2006/0130507 | A1 | 6/2006 | Grover | | |
| 2007/0245458 | A1 | 10/2007 | McGee | | |
| 2011/0094014 | A1 * | 4/2011 | Chang | A42B 1/248 | 2/175.1 |
| 2012/0073031 | A1 | 3/2012 | Horwitz et al. | | |
| 2012/0144555 | A1 | 6/2012 | Panicali | | |
| 2015/0237942 | A1 * | 8/2015 | Arkusz | A42B 3/28 | 2/195.1 |
| 2016/0157542 | A1 * | 6/2016 | Lee | A42C 5/04 | 2/171.3 |
| 2019/0075875 | A1 * | 3/2019 | Lacy | A42B 1/22 | |
| 2019/0090556 | A1 | 3/2019 | Ayres | | |
| 2019/0090568 | A1 * | 3/2019 | Votel | A42B 7/00 | |
| 2019/0254375 | A1 * | 8/2019 | Bloniarz, Jr. | A42B 1/02 | |
| 2020/0121016 | A1 * | 4/2020 | Skemp | A42B 1/08 | |
| 2023/0189915 | A1 | 6/2023 | Franklin et al. | | |
| 2023/0389637 | A1 * | 12/2023 | Gallant | A42B 1/041 | |

OTHER PUBLICATIONS

"RunCool Ice Run Hat," nathansports.com. Accessed: Feb. 11, 2024.https://www.nathansports.com/collections/shop-womens/products/runcool-ice-run-hat?variant=32615025705048&bvstate=pg%3A2%2Fct%3Ar.

Compressport Ice Caphttps://www.compressport.com/usa/en/sport-accessories/1290-ice-cap-sun-shade-white-7630102523997.html.

Vintage Novelty Hangover HatAdd some fun to your wardrobe with this vintage novelty Hangover Ice Pack IceBag Hat. Perfect for men who love 80s and 90s fashion, this adjustable baseballcap features a multicolor design that will make you stand out from the crowd. The hat is perfect for a day out with friends or for an outdoor event.https://www.mercari.com/us/item/m23281362062/?srsltid=AfmBOoqoxD5HQHFV6pVxyNOM8e15EFnNV2K3jleEfebVmR_F4ZuDf4uFj-Q.

* cited by examiner

ARTICLE OF HEADWEAR

CROSS-REFERENCE TO RELATED APPLICATION

This application claims priority under 35 U.S.C. § 119(e) to Provisional U.S. Patent Application No. 63/549,114, filed Feb. 2, 2024, the disclosure of which is hereby incorporated by reference in its entirety.

FIELD

The present invention relates in general to temperature regulating garments, and more particularly, to hats including a pocket to receive items for aiding cooling or heating of a user.

BACKGROUND

This section provides background information related to the present disclosure which is not necessarily prior art.

Athletes performing sports such as running often wear stand-alone bands or caps which incorporate a temperature regulating feature. Although these temperature regulating features provide some relief to the athlete, they often do not adequately provide the desired level of temperature regulation and often wear out their useful life short of the athlete's requirement.

BRIEF DESCRIPTION OF THE DRAWINGS

The detailed description of the invention will be described in relation to the accompanying drawings. In the drawings, the following figures have the following general nature.

Corresponding reference numerals indicate corresponding parts throughout the several views of the drawings.

DETAILED DESCRIPTION

Figure 1:
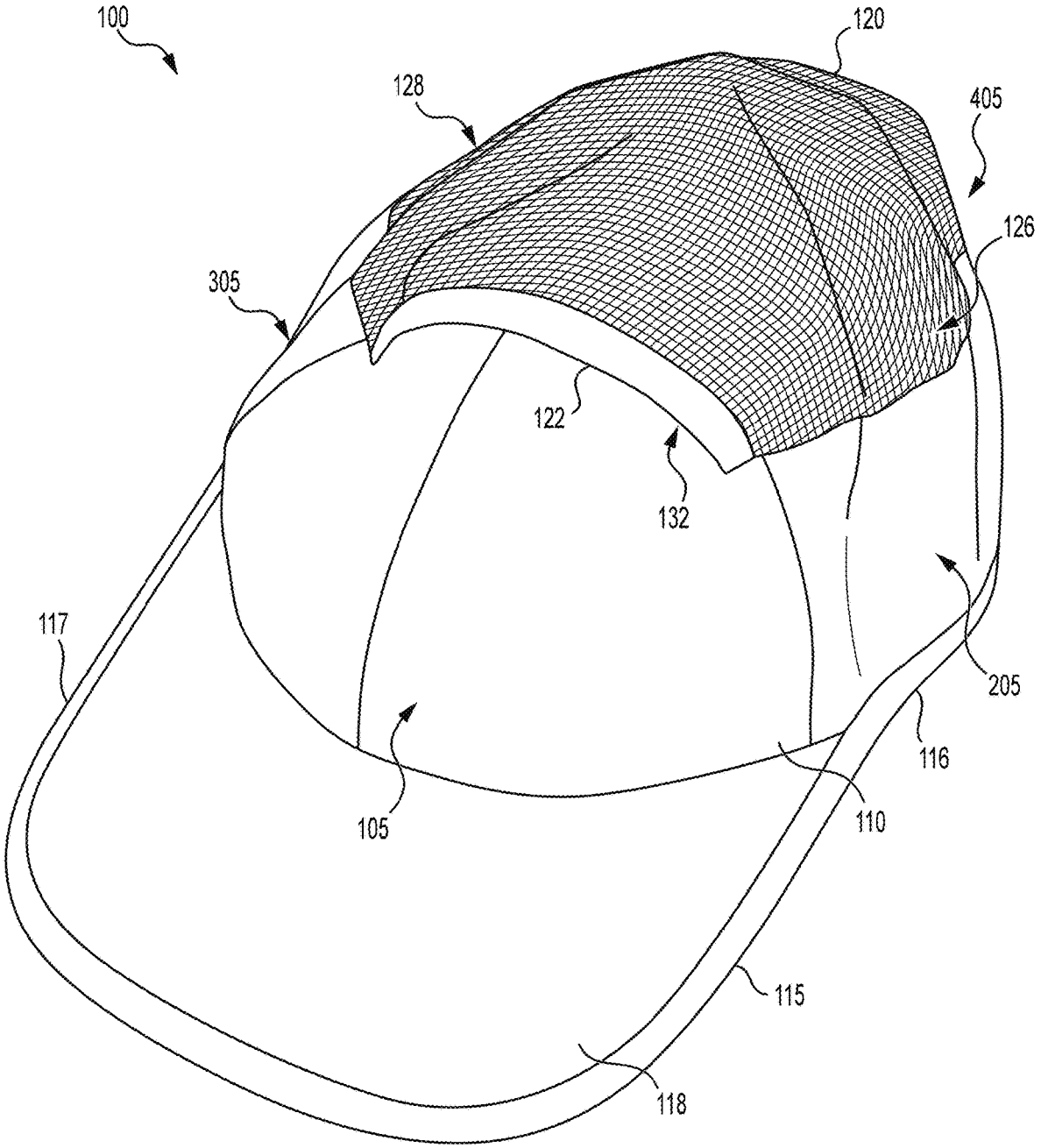
FIG. 1 is a perspective view of an article of headwear.
Figure 2:
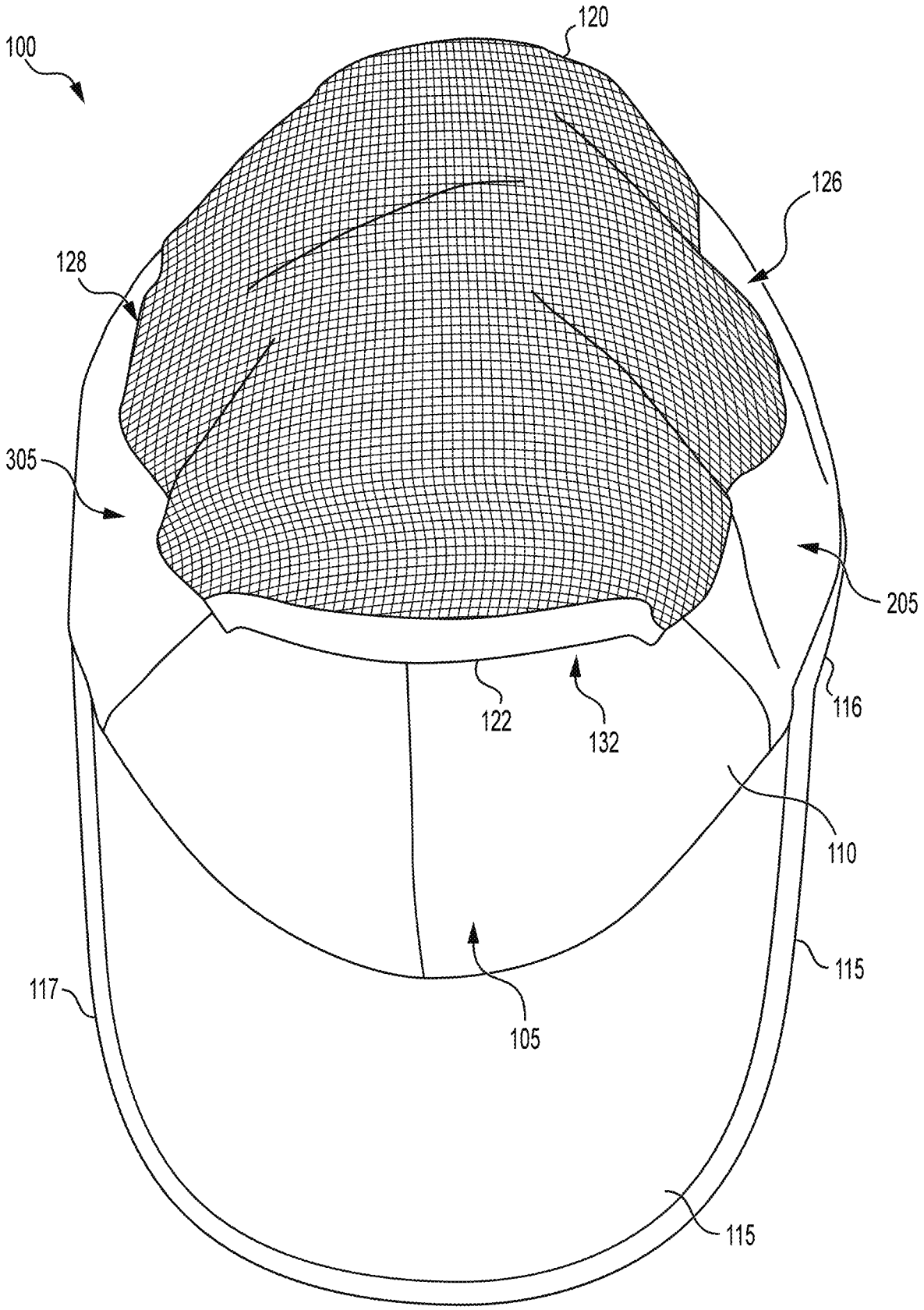
FIG. 2 is a top view of the article of headwear of FIG. 1.
Figure 3:
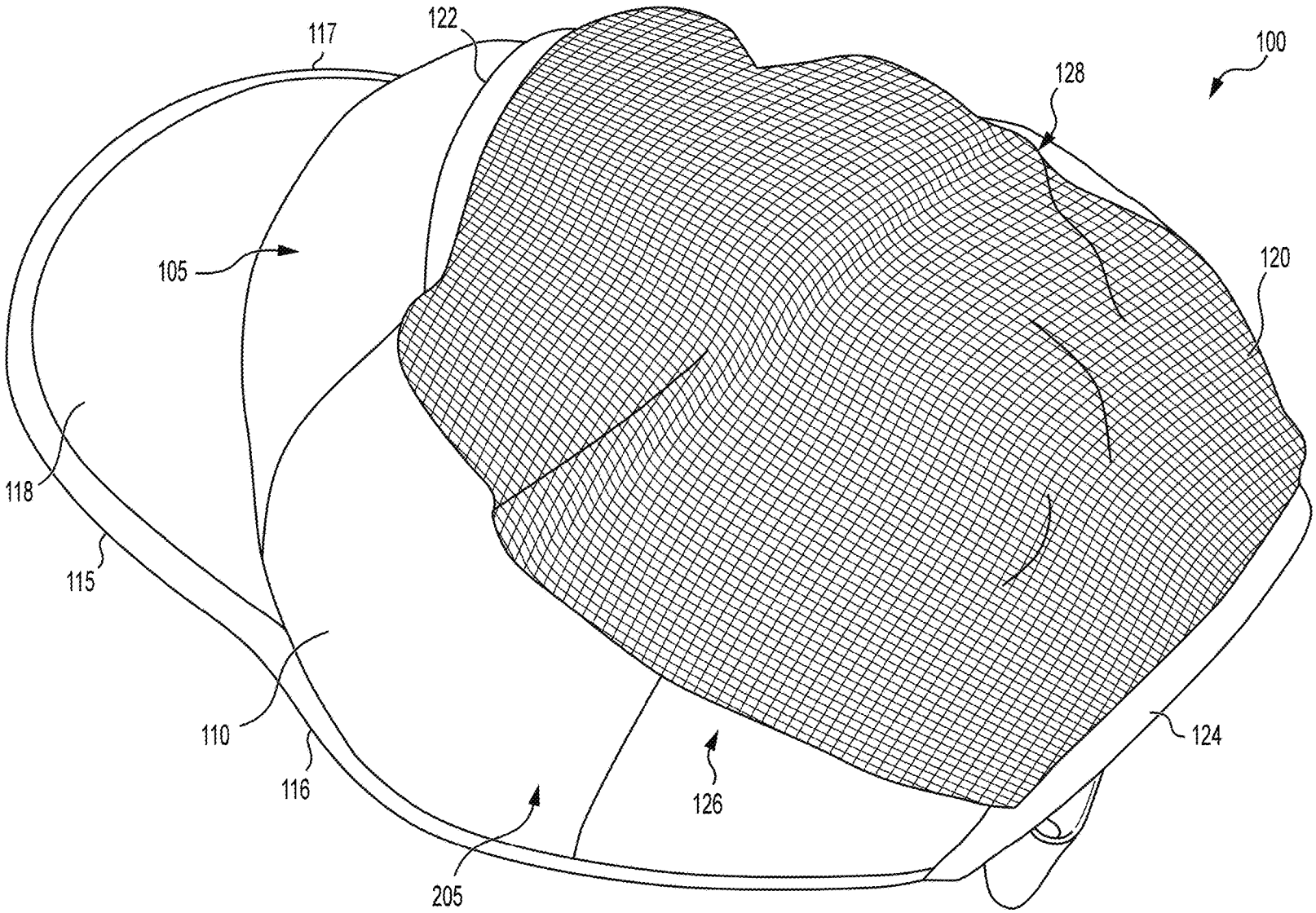
FIG. 3 is a perspective side view of the article of headwear of FIG. 1.
Figure 4:
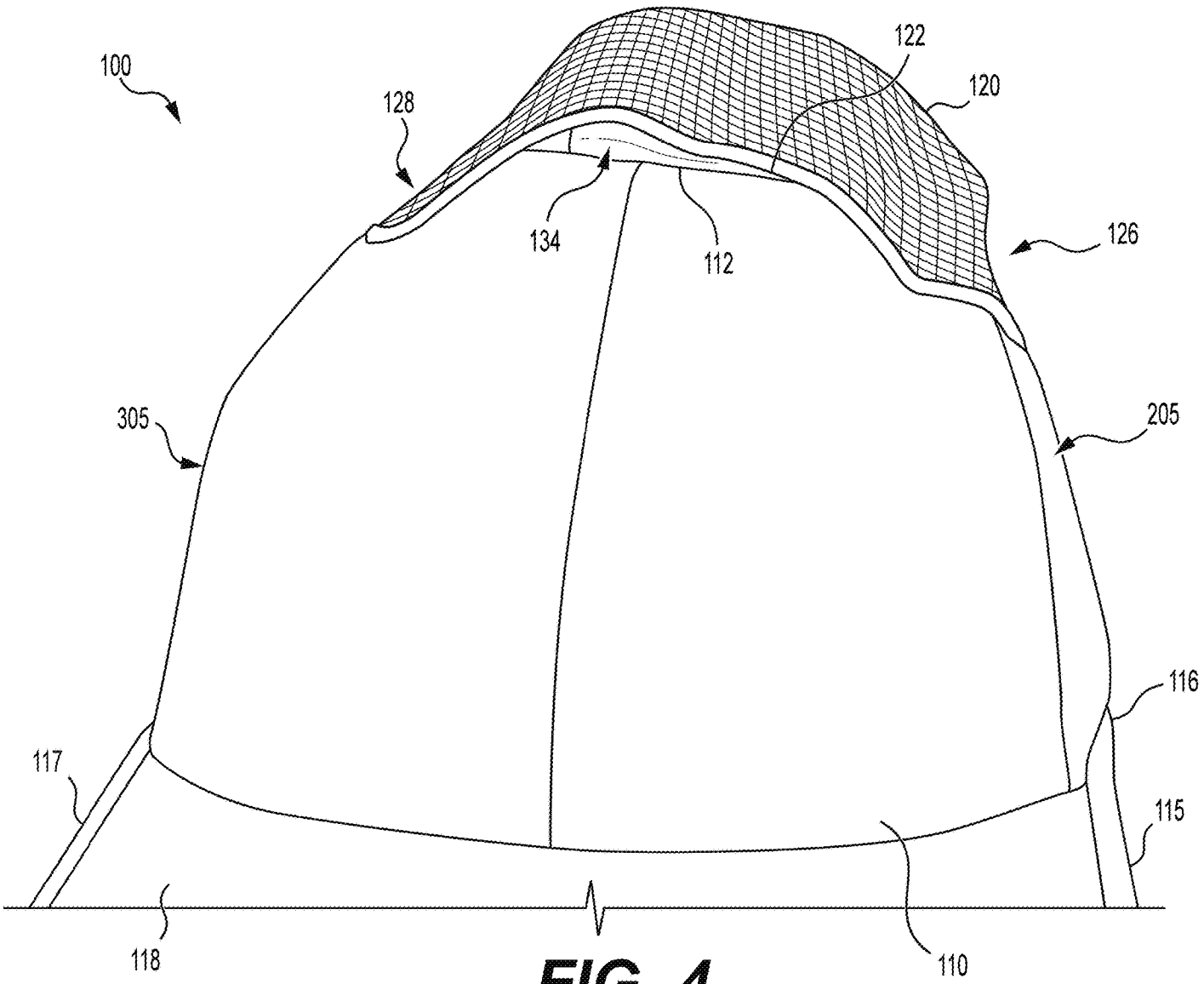
FIG. 4 is a detailed front view of the article of headwear of FIG. 1.

The present disclosure overcomes the above-mentioned challenges and other known disadvantages with existing article of headwear, by providing an article of headwear with access to a pocket of the article of headwear. Additionally, the present disclosure allows for the pocket to receive and contain various temperature regulating instruments.

Example configurations will now be described more fully with reference to the accompanying drawings. Example configurations are provided so that this disclosure will be thorough and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that the disclosed example configurations may be embodied in many different forms, and that the specific details and the example configurations should not be construed to limit the scope of the disclosure.

The terminology used herein is for the purpose of describing exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer, or section. Terms such as "first," "second," and other numerical terms do not imply a sequence or order unless clearly indicated by the context. Thus, a first element, component, region, layer, or section discussed below could be termed a second element, component, region, layer, or section without departing from the teachings of the example configurations. In the discussion that follows, terms "about," "approximately," "substantially," and the like, when used in describing a numerical value, denote a variation of +/−10% of that value, unless specified otherwise.

When an element or layer includes a directional and/or spatial term (e.g., top, bottom, medial, lateral, etc.), the directional and/or spatial term is used relative to when the article of headwear is upright on a flat, level surface.

Traditional articles of headwear which are worn during athletic activities lack the ability to efficiently or effectively regulate temperature. For example, articles of headwear typically lack a mechanism for storing a temperature regulation mechanism. Aspects herein provide for an article of headwear, such as, for example, a stand-alone sweatband, a cap, a visor, or other articles worn on the head of a person having an integrated pocket, to secure a temperature regulation mechanism. The article of headwear is configured to subsequently contain and allow the temperature regulation mechanism to cool and/or heat the athlete.

As used herein, the term "article of headwear" encompasses any structure configured to be worn on the head of a wearer. Thus, the article of headwear may comprise a stand-alone sweatband, or the article of headwear may include any number of constructions such as a cap with a crown and a bill (e.g., a baseball cap), a visor (e.g., a cap without a crown portion), a beanie, a beret, a bowler or derby, a fedora, a hard hat, a sun hat, and the like. In some example aspects, such as when the article of headwear is in the form of a cap, the article of headwear includes a crown. The term "crown" as used herein, means the portion of the article of headwear configured to be worn over the top portion of the wearer's head.

FIGS. 1-4 depict an article of headwear 100. The article of headwear 100 includes a crown 110, a bill 118 coupled to and extending from the front of the crown 110, and a mesh layer 120. The crown 110 may be divided into general regions for descriptive purposes including a front portion 105, a first side 205, a second side 305, and a back side 405 shown in FIG. 3. The front portion 105 of the crown may extend across the width of bill 118 from a first bill edge 115 to a second bill edge 117. The crown 110 also includes an apex 112 (shown in FIG. 4) positioned at the top of the crown 110, and a lower edge or lower margin 116. In one example aspect, the lower margin 116 of the crown 110 is configured to be positioned above the eyes of the wearer and also above the ears of the wearer, and the apex 112 is configured to be positioned adjacent to or above the top of the wearer's head. The description of the different regions is illustrative only and it is contemplated herein that the different regions may blend into each other without a clear demarcation.

The crown 110 may be formed from a polyester material such as, for example, about 70% polyester, about 80% polyester, about 90% polyester, or about 100% polyester. The crown 110 may also include elastomeric yarns such as, for example, spandex, or elastane.

The mesh layer 120 is formed of an lightweight material to provide breathability as well as to provide a structure for securement. The mesh layer 120 may be formed of polyester, nylon, spandex, or any other material capable of being stretched and returning to its original pre-stretched shape. The mesh layer 120 is configured to be stretched by a user of the article of headwear 100. The mesh layer 120 may be in a stretched configuration corresponding to the mesh layer 120 being stretched away from the crown 110 by the user. The mesh layer 120 may be in a relaxed configuration corresponding the mesh layer 120 being upstretched. The mesh layer 120 extends from the first side 205, across the crown 110, to the second side 305. The mesh layer 120 extends from at least a top-most portion of the front portion 105, across the crown 110, to at least a top-most portion of the back side 405. The mesh layer 120 includes a front end 122, a back end 124 (shown in FIG. 3), a right side 126, and a left side 128. The front end 122 and the back end 124 may be formed of a material that is different than the material of the mesh layer 120. For example, the front end 122 and the back end 124 may be formed of a material that is more elastic than a material of the mesh layer 120. The right side 126 of the mesh layer 120 is attached to the first side 205 of the article of headwear 100. The left side 128 of the mesh layer 120 is attached to the second side 305 of the article of headwear 100. The right side 126 and the left side 128 are attached to the article of headwear 100 via stitching, adhesive, or any other suitable means.

The mesh layer 120 extends above and across the crown 110 from the front end 122 to the back end 124 and the right side 126 to the left side 128 such that a pocket 130 (shown in FIG. 4) is formed between the mesh layer 120 and the crown 110. The space between the front end 122 and the crown 110 forms a first opening 132 that provides access to the pocket 130. The space between the crown 110 and the back end 124 forms a second opening 134. The second opening 134 may be smaller in area than an area of the first opening 132. In an example, the first opening 132 and the second opening 134 allow for fluid flow through the pocket 130. In other words, the pocket 130 is open to the environment at its back side and its front side. In other examples, the second opening 134 may be closed or substantially closed such that fluid flow from the first opening 132 and through the pocket 130 is blocked or substantially blocked at the second opening 134.

The mesh layer 120 is substantially perforated. In an example, an entirety of the mesh layer 120 is perforated. In some examples, only a portion of the mesh layer 120 is perforated. Any portion of the mesh layer 120 may be perforated as desired to provide venting and/or visibility to the contents of the pocket 130. In other examples, the mesh layer 120 may be formed of a solid opaque material.

As the mesh layer is stretched by the user into the stretched configuration, the size of the mouth of the opening 132 is increased to allow for insertion of an item, as will be described with reference to FIGS. 5 and 6.

Figure 5:
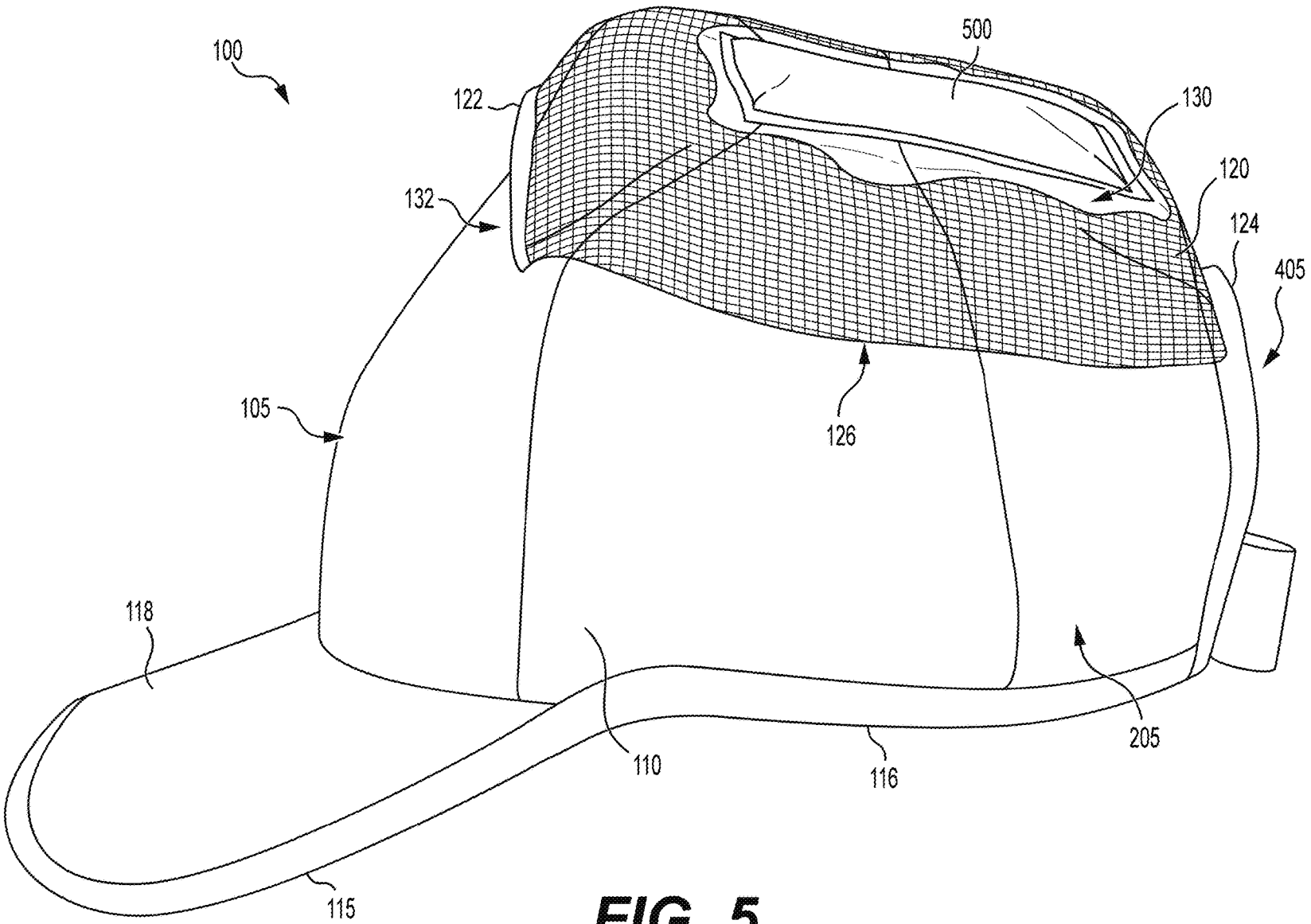
FIG. 5 is a side view of the article of headwear including a cut-away view of a mesh layer of the article of headwear of FIG. 1.
Figure 6:
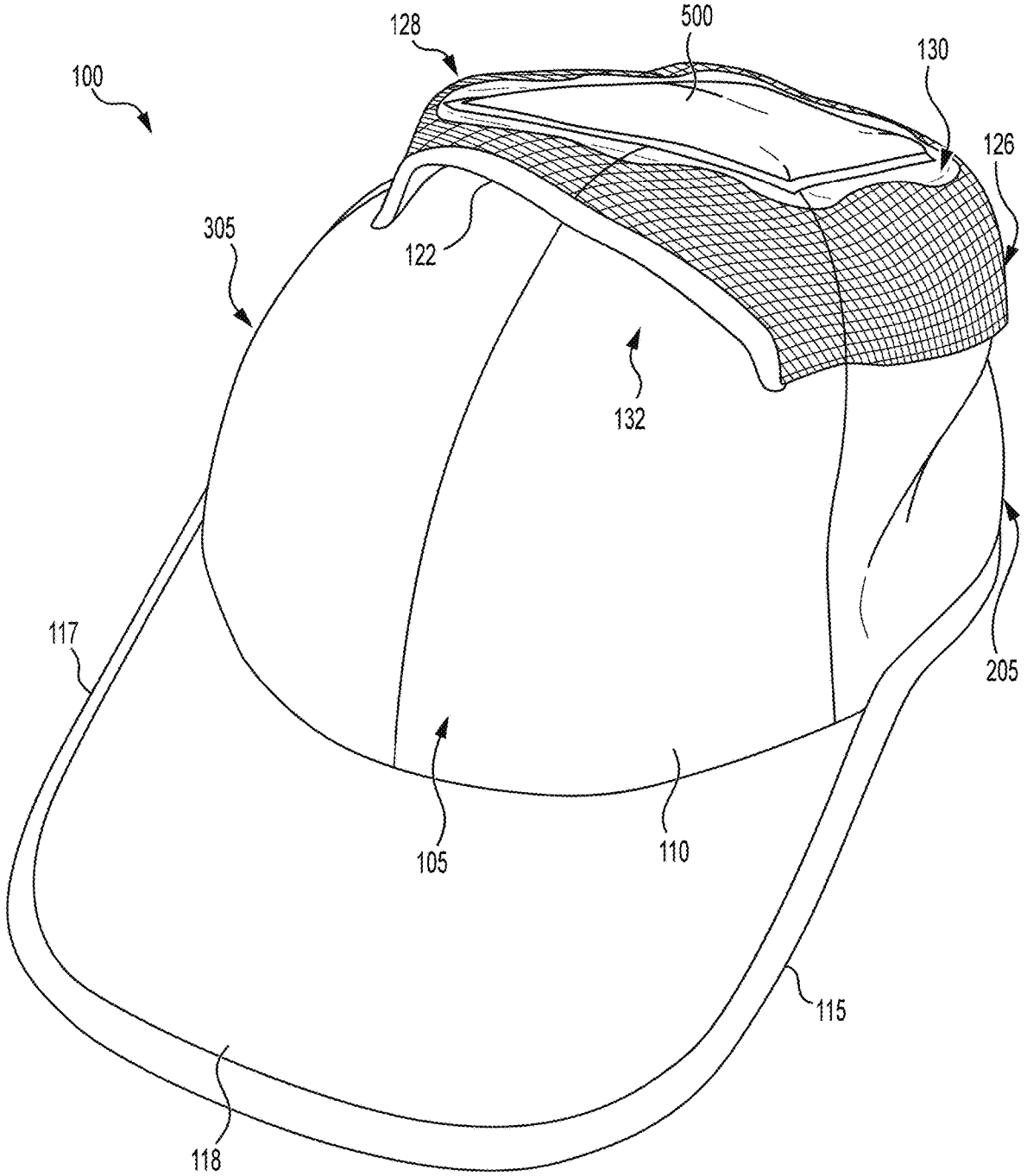
FIG. 6 is a perspective front view of the article of headwear including a cut-away view of a mesh layer of the article of headwear of FIG. 1.

Referring to FIGS. 5 and 6, a partial cut-away view of the article of headwear 100 is shown. In these figures, the mesh layer 120 is illustrated as cut away for illustration purposes to show a temperature regulation device 500 disposed within the pocket 130. The user lifts the front end 122 of the mesh layer 120, stretching the mesh layer 120, to gain access to the pocket 130 with the mesh layer 120 still in the stretched configuration. The temperature regulation device 500 is inserted into the pocket 130. Once the temperature regulation device 500 is inserted into the pocket 130, the user may release the front end 122, and the mesh layer 120 returns to the relaxed configuration to secure the temperature regulation device 500 within the pocket 130 at its front side. It is noted that in the relaxed configuration, the mesh layer 120 may retain some level of stretch in order to retain the temperature regulation device 500 within the pocket 130. Due to the second opening 134 being smaller than the first opening 132, the temperature regulation device 500 is secured within the pocket 130 in the back side of the pocket 130. It is contemplated, that the user may also lift the second opening 134 to insert the temperature regulation device 500. In an example, the temperature regulation device 500 is an ice pack. In other examples, the temperature regulation device 500 may be a sponge, a bag of ice, free ice, a heat pack, or any other device suitable for helping regulate, increase, or decrease a user's body temperature or temperature of the user's head.

In alternative examples, the mesh layer 120 may be disposed on an interior portion of the article of headwear 100. In such an example, the pocket 130 is disposed on the interior portion of the article of headwear 100. In other examples, the article of headwear 100 may be perforated or comprised on a material capable of allowing moisture to seep through. In other examples, the mesh layer 120 may be a separate component that is coupled to the article of headwear 100. In other examples, the mesh layer 120 may be disposed and attached at any other portion of the article of headwear 100 as desired to hold a temperature regulation device 500.

Since many possible embodiments may be made of the invention without departing from the scope thereof, it is to be understood that all matter herein set forth or shown in the accompanying drawings is to be interpreted as illustrative and not in a limiting sense.

The following clauses provide an exemplary configuration for an article of footwear and sole structure described above.

Clause 1. An article of headwear including: a crown including a front portion, a first side, a second side disposed opposite the first side, and a back side opposite the front portion, wherein the crown includes an apex disposed at a top most point of the crown; a bill extending away from the front portion of the crown; and a mesh layer attached to the crown, the mesh layer extending from the first side of the crown to the second side of the crown and including a first end, a second end, a left side, and a right side, wherein the mesh layer forms a pocket between the first end, the second end, the left side, and the right side, the pocket bounded at its top by the mesh layer and bounded at its bottom by the crown.

Clause 2. The article of headwear of Clause 1, wherein a temperature regulation device is disposed within the pocket.

Clause 3. The article of headwear of Clause 1, wherein the mesh layer comprises a lightweight material.

Clause 4. The article of headwear of Clause 3, wherein the lightweight material is one of polyester, nylon, or spandex.

Clause 5. The article of headwear of Clause 1, wherein the mesh layer is operable between a first configuration and a second configuration, wherein the first configuration is a stretched configuration of the mesh layer and the second configuration is a relaxed configuration of the mesh layer.

Clause 6. The article of headwear of Clause 1, wherein the each of the first end and the second end are formed of a material that is different than a material of the mesh layer.

Clause 7. The article of headwear of Clause 1, wherein the mesh layer is perforated.

Clause 8. The article of headwear of Clause 1, wherein a first opening is formed between the first end of the mesh layer and the end crown, and wherein a second opening is formed between the second end of the mesh layer and the crown.

Clause 9. The article of headwear of Clause 8, wherein the second opening is smaller in size than is the first opening.

Clause 10. An article of headwear including: a crown having an interior portion opposite an exterior portion, the crown including a front portion, a first side, a second side disposed opposite the first side, and a back side opposite the front portion, wherein the crown includes an apex disposed at a top most point of the crown; a bill extending away from the front portion of the crown; and a mesh layer attached to the interior portion of the crown, the mesh layer extending from the first side of the crown to the second side of the crown and including a first end, a second end, a left side, and a right side, wherein the mesh layer forms a pocket between the first end, the second end, the left side, and the right side, the pocket bounded at its top by the crown and bounded at its bottom by the mesh layer.

Clause 11. The article of headwear of Clause 10, wherein a temperature regulation device is disposed within the pocket.

Clause 12. The article of headwear of Clause 10, wherein the mesh layer comprises a lightweight material.

Clause 13. The article of headwear of Clause 12, wherein the lightweight material is one of polyester, nylon, or spandex.

Clause 14. The article of headwear of Clause 10, wherein the mesh layer is operable between a first configuration and a second configuration, wherein the first configuration is a stretched configuration of the mesh layer and the second configuration is a relaxed configuration of the mesh layer.

Clause 15. The article of headwear of Clause 10, wherein the each of the first end and the second end are formed of a material that is different than a material of the mesh layer.

Clause 16. The article of headwear of Clause 10, wherein the mesh layer is perforated.

Clause 17. The article of headwear of Clause 10, wherein a first opening is formed between the first end of the mesh layer and the end crown, and wherein a second opening is formed between the second end of the mesh layer and the crown.

Clause 18. The article of headwear of Clause 17, wherein the second opening is smaller in size than is the first opening.

Clause 19. The article of headwear of Clause 10, wherein a portion of the mesh layer is perforated.

Clause 20. The article of headwear of Clause 10, wherein a first opening is formed between the first end of the mesh layer and the crown, and wherein a second opening is formed between the second end of the mesh layer and the crown, the second opening being substantially closed.

I claim:

1. An article of headwear including:

a crown including a front portion, a first side, a second side disposed opposite the first side, and a back side opposite the front portion, wherein the crown includes an apex disposed at a top most point of the crown;

a bill extending away from the front portion of the crown; and a mesh layer attached to the crown, the mesh layer extending from the first side of the crown to the second side of the crown and including a first end, a second end, a left side, and a right side, wherein the mesh layer forms a pocket between the first end, the second end, the left side, and the right side, the pocket bounded at its top by the mesh layer and bounded at its bottom by the crown, the pocket including a first opening and a second opening, the first opening disposed at the first end of the mesh layer and the second opening disposed at the second end of the mesh layer.

2. The article of headwear of claim 1, further comprising a temperature regulation device disposed within the pocket.

3. The article of headwear of claim 1, wherein the mesh layer comprises a lightweight material.

4. The article of headwear of claim 3, wherein the lightweight material is one of polyester, nylon, or spandex.

5. The article of headwear of claim 1, wherein the mesh layer is operable between a first configuration and a second configuration, wherein the first configuration is a stretched configuration of the mesh layer and the second configuration is a relaxed configuration of the mesh layer.

6. The article of headwear of claim 1, wherein at least one of the first end or the second end of the mesh layer is formed of a different material than a material of another portion of the mesh layer.

7. The article of headwear of claim 1, wherein the mesh layer is perforated.

8. The article of headwear of claim 1, wherein the second opening is smaller in size than is the first opening.

9. An article of headwear including: a crown having an interior portion opposite an exterior portion, the crown including a front portion, a first side, a second side disposed opposite the first side, and a back side opposite the front portion, wherein the crown includes an apex disposed at a top most point of the crown; a bill extending away from the front portion of the crown; and a mesh layer attached to the interior portion of the crown, the mesh layer extending from the first side of the crown to the second side of the crown and including a first end, a second end, a left side, and a right side, wherein the mesh layer forms a pocket between the first end, the second end, the left side, and the right side, the pocket bounded at its top by the crown and bounded at its bottom by the mesh layer, the pocket including a bottom adjacent to the back side of the crown and a top adjacent to the apex of the crown, the pocket including a plurality of openings at uppermost and lowermost ends of the pocket.

10. The article of headwear of claim 9, further comprising a temperature regulation device disposed within the pocket.

11. The article of headwear of claim 9, wherein the mesh layer comprises a lightweight material.

12. The article of headwear of claim 11, wherein the lightweight material is one of polyester, nylon, or spandex.

13. The article of headwear of claim 9, wherein the mesh layer is operable between a first configuration and a second configuration, wherein the first configuration is a stretched configuration of the mesh layer and the second configuration is a relaxed configuration of the mesh layer.

14. The article of headwear of claim 9, wherein each of the first end and the second end are formed of a material that is different than a material of the mesh layer.

15. The article of headwear of claim 9, wherein the mesh layer is perforated.

16. The article of headwear of claim 9, wherein a first opening of the plurality of openings is formed between the first end of the mesh layer and the crown, and wherein a second opening is formed between the second end of the mesh layer and the crown.

17. The article of headwear of claim 16, wherein the second opening is smaller in size than is the first opening.

18. The article of headwear of claim 9, wherein a portion of the mesh layer is perforated.

19. The article of headwear of claim 9, wherein a first opening is formed between the first end of the mesh layer and the crown, and wherein a second opening is formed between the second end of the mesh layer and the crown, the second opening being closed.

* * * * *